US007740529B2

(12) United States Patent
Quattrini et al.

(10) Patent No.: US 7,740,529 B2
(45) Date of Patent: Jun. 22, 2010

(54) COIN DISPENSER WITH AUTO-LATCHING COIN CANISTER

(75) Inventors: Victor A. Quattrini, Merrimac, MA (US); Robert Pitman, Beverly, MA (US); Jack J. Bisson, Groveland, MA (US); Hamlin Peterke, Exeter, NH (US)

(73) Assignee: Telequip Corporation, Salem, NH (US)

( * ) Notice: Subject to any disclaimer, the term of this patent is extended or adjusted under 35 U.S.C. 154(b) by 0 days.

(21) Appl. No.: 11/525,206

(22) Filed: Sep. 21, 2006

(65) Prior Publication Data

US 2007/0084909 A1 Apr. 19, 2007

Related U.S. Application Data

(60) Provisional application No. 60/719,538, filed on Sep. 22, 2005.

(51) Int. Cl.
*G07D 1/00* (2006.01)
*G07D 11/00* (2006.01)

(52) U.S. Cl. ..... 453/18; 232/64

(58) Field of Classification Search ..... 453/18, 453/61; 902/10

See application file for complete search history.

(56) References Cited

U.S. PATENT DOCUMENTS 4,153,197 A * 5/1979 Hall ..... 232/5
4,374,529 A * 2/1983 Kobayashi et al. ..... 453/17
5,332,091 A * 7/1994 Gugler ..... 206/167
5,426,282 A * 6/1995 Humble ..... 235/383
5,830,055 A 11/1998 Jones et al.
5,989,118 A * 11/1999 Chiba et al. ..... 453/11
6,793,571 B2 * 9/2004 Chung ..... 453/60
7,264,150 B1 * 9/2007 Moreland et al. ..... 235/379
2005/0107024 A1 5/2005 Quattrini et al.

FOREIGN PATENT DOCUMENTS

EP 1 471 468 A1 10/2004

OTHER PUBLICATIONS

Communication pursuant to Article 94(3) EPC dated February 25, 2009 in connection with European Patent Application No. 06 815 136.4.

* cited by examiner

*Primary Examiner*—Patrick Mackey
*Assistant Examiner*—Mark Beauchaine

(57) ABSTRACT

A coin dispenser includes a coin canister that automatically locks into the dispenser. A remotely operated mechanism may unlock the canister from the dispenser. The dispenser may serve as a loading stand for the canister. The canister may be adapted for manual loading of coins into the canister without removing the canister from the dispenser. The canister may include a receptacle for coins and an aperture adapted to facilitate loading coins into the receptacle and to retain coins in the receptacle. The canister may include a repositionable handle that covers an aperture of the canister in one position and serves as a carrying handle in another position. A system for dispensing coins includes a controller electrically connected to a coin dispenser. The dispenser includes a coin canister and a latch that locks the canister to the dispenser. The controller can send an electrical signal that unlocks the canister.

26 Claims, 4 Drawing Sheets

COIN DISPENSER WITH AUTO-LATCHING COIN CANISTER

The present application is related to U.S. Provisional Patent No. 60/719,538, filed Sep. 22, 2005, entitled "LOAD IN PLACE COIN DISPENSER". U.S. Provisional Patent No. 60/719,538 is assigned to the assignee of the present application and is hereby incorporated by reference into the present disclosure as if fully set forth herein. The present application hereby claims priority under 35 U.S.C. §119(e) to U.S. Provisional Patent No. 60/719,538.

TECHNICAL FIELD OF THE INVENTION

The present invention is directed, in general, to coin dispensers and, more specifically, to coin dispensers with automatically latching coin canisters.

BACKGROUND OF THE INVENTION

Coin dispensers may employ a canister for holding a supply of coins in various denominations. The coins may be held in stacks in tubular receptacles within the canister. Each stack may be made up of a different denomination of coin and each denomination may have a different diameter. A canister may be filled manually in advance of its deployment and the canister may be periodically replenished as its supply of coins is depleted. When the supply of one or more denominations of coins ill a canister is depleted, the canister is typically removed from the coin dispenser and transported to a remote location where it may be refilled with a full coin inventory.

A canister is generally locked in place in a coin dispenser to prevent its unauthorized removal. Typically, a conventional lock requiring physical actuation with a key is used for this purpose. In such dispensers the key is required both to unlock the canister from and lock the canister into the coin dispenser. As a result, in a typical point of sale environment, a cashier must call for management intervention to unlock a canister to enable its replacement and removal for replenishment. Once the canister has been replenished, the cashier must then call for managerial intervention a second time to lock the canister back into place. Alternatively, the cashier may operate the coin dispenser with the coin canister in an unlocked condition, in order to avoid the inconvenience of further managerial intervention. However, such operation may compromise the security of coin dispenser operation As such, removal of a canister is an event that typically requires managerial supervision both to unlock and relock the canister in a coin dispenser. In some applications, however, it may be desirable to allow partial or complete replenishment of the coin supply in a canister at the coin dispenser, in order both to prolong a period of time between refills of the coin canister and to reduce down time of the coin dispenser when early depletion of the coin canister occurs.

Furthermore, a coin canister typically has a small horizontal cross-section, or 'footprint', in relation to its height. As such, a stand is typically required to support the canister during loading or replenishment of the coin supply.

Typically, a coin canister is constructed with a cover that operates to close an open top of a coin receptacle and assist in retaining inserted coins. Such a cover also provides security for the coin supply by preventing unauthorized removal of coins from the coin canister. Although the cover may be removed for complete refilling of a canister, it typically prevents interim replenishment of the coin canister at the point of use. Some covers may allow a cashier to deposit coins into the canister one at a time.

Furthermore, even with the cover removed, replenishment of the coin supply in a canister through the open tops of the coin receptacles is typically awkward. A complete roll of coins, that is, a tall stack of coins, may often not be inserted without dropping some of the coins. As a result, users will often insert partial rolls, or shorter stacks, to avoid this occurrence. This may cause the replenishment process to take longer than it otherwise would.

In some coin canisters, long openings in a front face of the canister near the top of a tubular receptacle may be provided, to allow stacks of coins to be inserted into the receptacle. However, such openings typically leave only the back half of the receptacle. As a result, coins in the opening may fall forward out of the canister if the canister is in a vertical position or is carried without a protective cover in place to retain the coins in the opening.

There is, therefore, a need in the art for improved flexibility of coin canister insertion and removal into coin dispensers and improved methods of loading coins into a coin canister.

SUMMARY OF THE INVENTION

To address the above-discussed deficiencies of the prior art, it is an object of this invention to provide a coin canister for a coin dispenser that allows for convenient partial or complete replenishment of its coin supply without removing the canister from the vicinity of the coin dispenser. It is a further object of this invention to provide a coin canister that may be positioned securely and conveniently for replenishment of its coin supply. It is also an object of this invention to provide a coin canister for a coin dispenser that requires less managerial involvement in removal and replacement of the coin canister in the coin dispenser. It is a further object of this invention to provide openings in a coin canister that facilitate manual insertion of coins into receptacles of the canister, while retaining inserted coins in the receptacles. It is also an object of this invention to provide a cover for a coin canister that does not hinder replenishment of the coin supply in the coin canister.

Aspects of the present invention may be found in a coin dispenser that includes a coin canister and a latch that is operable to automatically lock the canister to the dispenser. A remotely operated mechanism may unlock the canister from the dispenser. The dispenser may serve as a loading stand for the canister. The canister may be adapted for manual loading of coins into the canister without removing the canister from the dispenser. The canister may include a receptacle and an opening that facilitates manual insertion of coins into the receptacle and retains coins inserted in the receptacle. The canister may include a repositionable handle that covers an aperture of the canister in one position and serves as a carrying handle in another position.

Other aspects of the present invention may be found in a coin canister that includes a feature that is operable to couple with a latch of a coin dispenser to automatically lock the canister to the dispenser. The canister may be adapted for manual loading of coins into the canister without removing the canister from the dispenser. The canister may include a receptacle and an opening that facilitates manual insertion of coins into the receptacle and retains coins inserted in the receptacle. The canister may include a repositionable handle that covers an aperture of the canister in one position and serves as a carrying handle in another position.

Still other aspects of the invention may be found in a method for use with a coin dispenser that includes a coin canister. The method includes automatically locking the coin canister to the coin dispenser. The method may include remotely operating a mechanism to unlock the coin canister from the coin dispenser. The method may include using the coin dispenser as a loading stand for the coin canister. The method may include manually loading coins into the coin canister without removing the canister from the dispenser. The method may include providing an opening in the canister that facilitates manual insertion of coins into the receptacle and retains coins inserted in the receptacle. The method may include providing a repositionable handle that covers an aperture of the canister in one position and serves as a carrying handle in another position.

Other aspects of the invention may be found in a coin dispenser that includes a coin canister that can couple with the dispenser in a first position for loading coins into the canister and in a second position for dispensing a coin from the dispenser. The coin dispenser may also include a latch that locks the canister to the dispenser and a remotely operated mechanism that unlocks the canister from the dispenser. The coin canister may be adapted for manually loading coins into the canister with out removing the canister from the dispenser. The canister may include a receptacle and an opening that facilitates manual insertion of coins into the receptacle and retains coins inserted in the receptacle. The coin canister may include a repositionable handle that covers an aperture of the canister in one position and serves as a carrying handle in another position.

Still other aspects of the invention may be found in a system for dispensing coins that includes a controller and a coin dispenser electrically connected to the controller. The dispenser includes a coin canister and a latch that locks the canister to the dispenser. The controller can send an electrical signal that unlocks the canister from the dispenser. The controller may be either a point-of-sale (POS) terminal or a POS host system. Where the controller is a POS host system, the coin dispenser may include a plurality of coin dispensers.

The foregoing has outlined rather broadly the features and technical advantages of the present invention so that those skilled in the art may better understand the detailed description of the invention that follows. Additional features and advantages of the invention will be described hereinafter that form the subject of the claims of the invention. Those skilled in the art will appreciate that they may readily use the conception and the specific embodiment disclosed as a basis for modifying or designing other structures for carrying out the same purposes of the present invention. Those skilled in the art will also realize that such equivalent constructions do not depart from the spirit and scope of the invention in its broadest form.

Before undertaking the DETAILED DESCRIPTION OF THE INVENTION below, it may be advantageous to set forth definitions of certain words or phrases used throughout this patent document: the terms "include" and "comprise," as well as derivatives thereof, mean inclusion without limitation; the term "or" is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, whether such a device is implemented in hardware or in firmware or software executing on hardware. It should be noted that the functionality associated with any particular controller may be centralized or distributed, whether locally or remotely. Definitions for certain words and phrases are provided throughout this patent document, and those of ordinary skill in the art will understand that such definitions apply in many, if not most, instances to prior as well as future uses of such defined words and phrases.

BRIEF DESCRIPTION OF THE DRAWINGS

For a more complete understanding of the present invention, and the advantages thereof, reference is now made to the following descriptions taken in conjunction with the accompanying drawings, wherein like numbers designate like objects, and in which.

DETAILED DESCRIPTION OF THE INVENTION

FIGS. 1 through 8, discussed below, and the various embodiments used to describe the principles of the present invention in this patent document are by way of illustration only and should not be construed in any way to limit the scope of the invention. Those skilled in the art will understand that the principles of the present invention may be implemented in any suitably arranged device.

Although the present invention has been described in detail, those skilled in the art will understand that various changes, substitutions, variations, enhancements, nuances, gradations, lesser forms, alterations, revisions, improvements and knock-offs of the invention disclosed herein may be made without departing from the spirit and scope of the invention in its broadest form.

Figure 1:
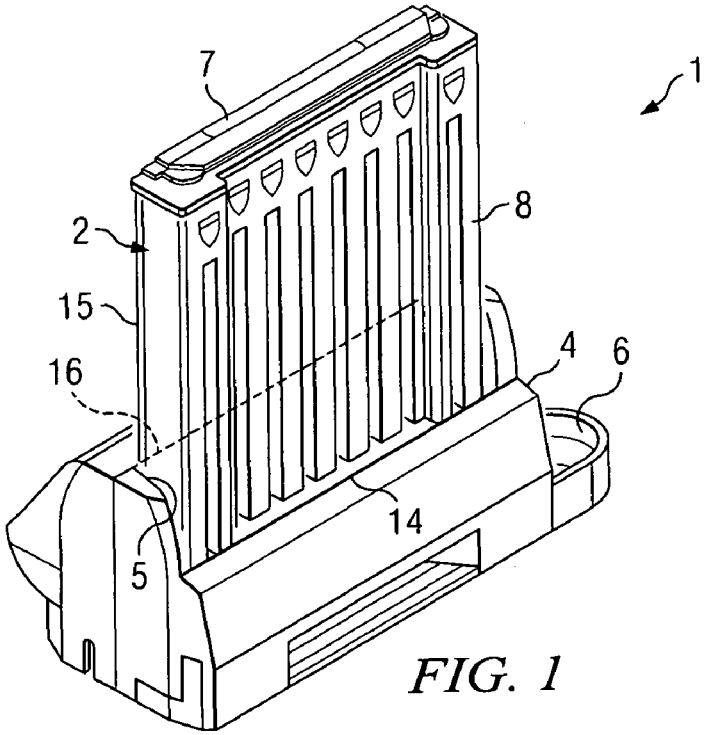
FIG. 1 is an orthogonal view of a coin dispenser according to the invention with a coin canister in a dispensing position.

FIG. 1 shows a coin dispenser 1, including a coin canister 2 that may hold a supply of coins of various denominations. The coins may be held in stacks within tubular receptacles 3 constructed in the coin canister 2. Each stack may be a different denomination of coin and each of the tubular receptacles 3 may have a different diameter. The coin dispenser 1 may have an outer enclosure 4 with an opening 5 into which the coin canister 2 may be inserted. A coin cup 6 may be positioned at an outlet of the coin dispenser 1 for the coins dispensed from the coin canister 2.

The coin canister 2 may include a carrying handle 7, which may be placed in a first position to act as a cover for the coin canister 2, as shown in FIG. 1. The carrying handle 7 may include elongated slots 25, which may be captured by associated pivot pins (not shown) in the coin canister 2. In this way, the carrying handle 7 may be raised into a second position and used as a handle to withdraw the coin canister 2 from the coin dispenser 1 and to conveniently transport the coin canister 2 to another location. The carrying handle 7 may also be folded back, as shown in FIGS. 2 and 3, during full or partial replenishment of the coin canister 2.

Figure 2:
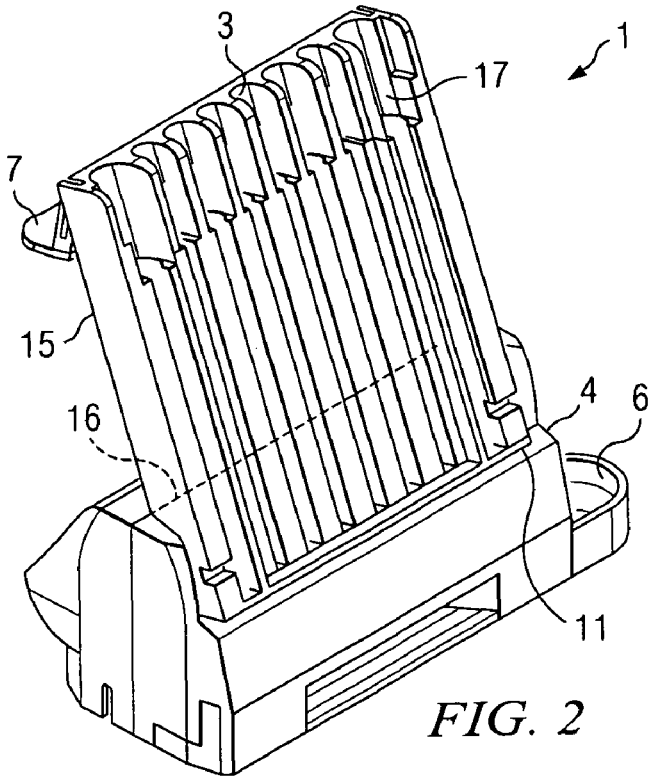
FIG. 2 is an orthogonal view of the coin dispenser of FIG. 1 with the coin canister in a replenishment position.
Figure 3:
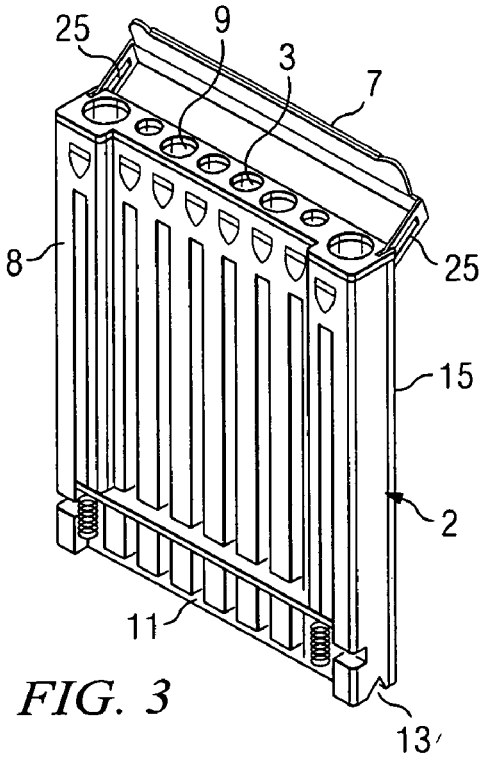
FIG. 3 is an orthogonal view of the coin canister of the embodiment of the invention shown in FIG. 1.

The coin canister 2 may be removed from the dispensing position shown in FIG. 1 and placed into a replenishment position, as shown in FIG. 2. In the replenishment position, the coin canister may rest on a first edge 14 of the opening 5 and lean back at a convenient angle so that a back 15 of the coin canister 2 rests against a second edge 16 of the opening 5. In the embodiment of the invention shown in FIG. 2, the coin canister 2 is at an angle of about 30 degrees from the vertical. In this way, the coin dispenser 1 may serve as a loading stand for replenishing the coin supply of the coin canister 2.

A feature such as a groove 13 may be formed in a base or foot 11 of the coin canister 2 to engage the edge 14 of the opening 5, in order to secure the coin canister 2 and prevent it from sliding out of the replenishment position shown in FIG. 2. The groove 13 is visible in FIGS. 3, 4 and 6.

In another embodiment of the present invention, the edge 14 of the opening 5 may be formed with a feature such as a U-shaped channel that is sized to receive the foot 11 of the coin canister 2. Such a channel of the coin dispenser 1 may act to retain the coin canister 2 in the replenishment position shown in FIG. 2.

The coin canister 2 may include an outer cover 8 which may be removed to permit full replenishment of coins in the coin canister 2. Removing the outer cover 8 and moving the carrying handle 7 to the position shown in FIG. 2 may uncover relieved areas 17 in the tubular receptacles 3 of the coin canister 2. The enlarged access provided by the relieved areas 17 may enable more rapid replenishment of the coin canister 2 by facilitating insertion of larger stacks, or entire rolls, of coins than would otherwise be possible. Furthermore, despite the presence of relieved areas 17, tubular receptacles 3 extends more than 180 degrees around the periphery of coins inserted therein. In this way, coins are retained in the tubular receptacles 3 in the relieved regions 17, as in the remainder of the tubular receptacles 3.

When the coin canister 2 is in the dispensing position shown in FIG. 1, its coin supply may also be replenished. The carrying handle 7 may be moved to the position shown in FIG. 3, which may reveal openings 9 in the canister cover 8. The openings 9 may allow a cashier to transfer small stacks of coins (for example, 5-10 coins) from a cash drawer into the tubular receptacles 3 of the coin canister 2. In this way, replenishment of the coin supply in the coin canister 2 may be performed by the cashier, as needed, without removing the coin canister 2 from the coin dispenser 1. As such, managerial intervention to unlock the coin canister 2 from the coin dispenser 1 to perform replenishment in a remote location or on site, as described with reference to FIG. 2, may be delayed or eliminated altogether.

A coin canister is typically locked into a coin dispenser with a lock cylinder actuated by a key. As may be seen in FIGS. 4-6, a coin dispenser according to the present invention may also be provided with a keyed mechanism to unlock the coin canister 2 from the coin dispenser 1. However, the coin dispenser 1 may also or alternatively be provided with a solenoid-actuated locking mechanism 18, to allow the coin canister 2 to be unlocked without the use of a key. Where the coin dispenser 1 is provided with a locking mechanism actuated by either a key or a solenoid, the key may be used to unlock the coin canister 2 when the solenoid or its control circuitry malfunctions or when power is lost or switched off.

Figure 4:
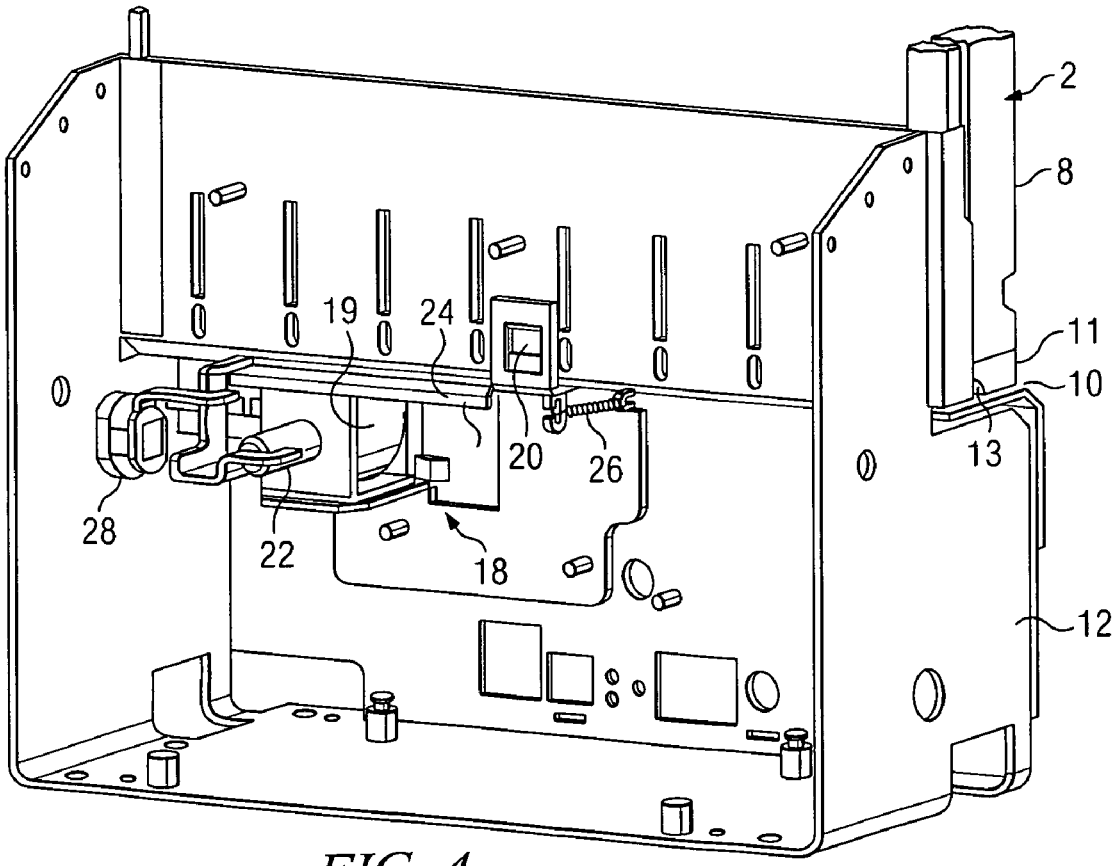
FIG. 4 is a view of an inner chassis of the coin dispenser of the embodiment of the invention shown in FIG. 1.
Figure 5:
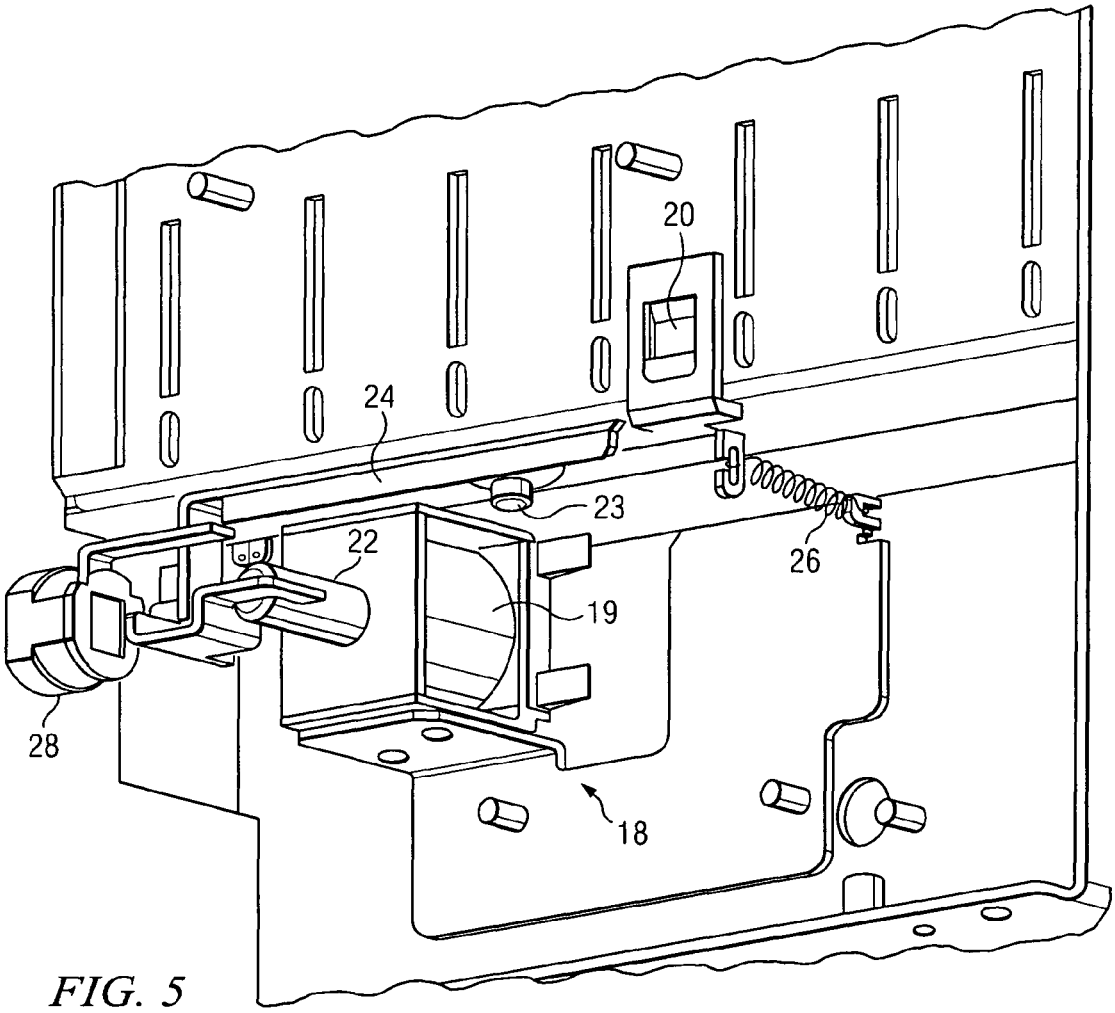
FIG. 5 is a close up view of the locking mechanism shown in FIG. 4.
Figure 6:
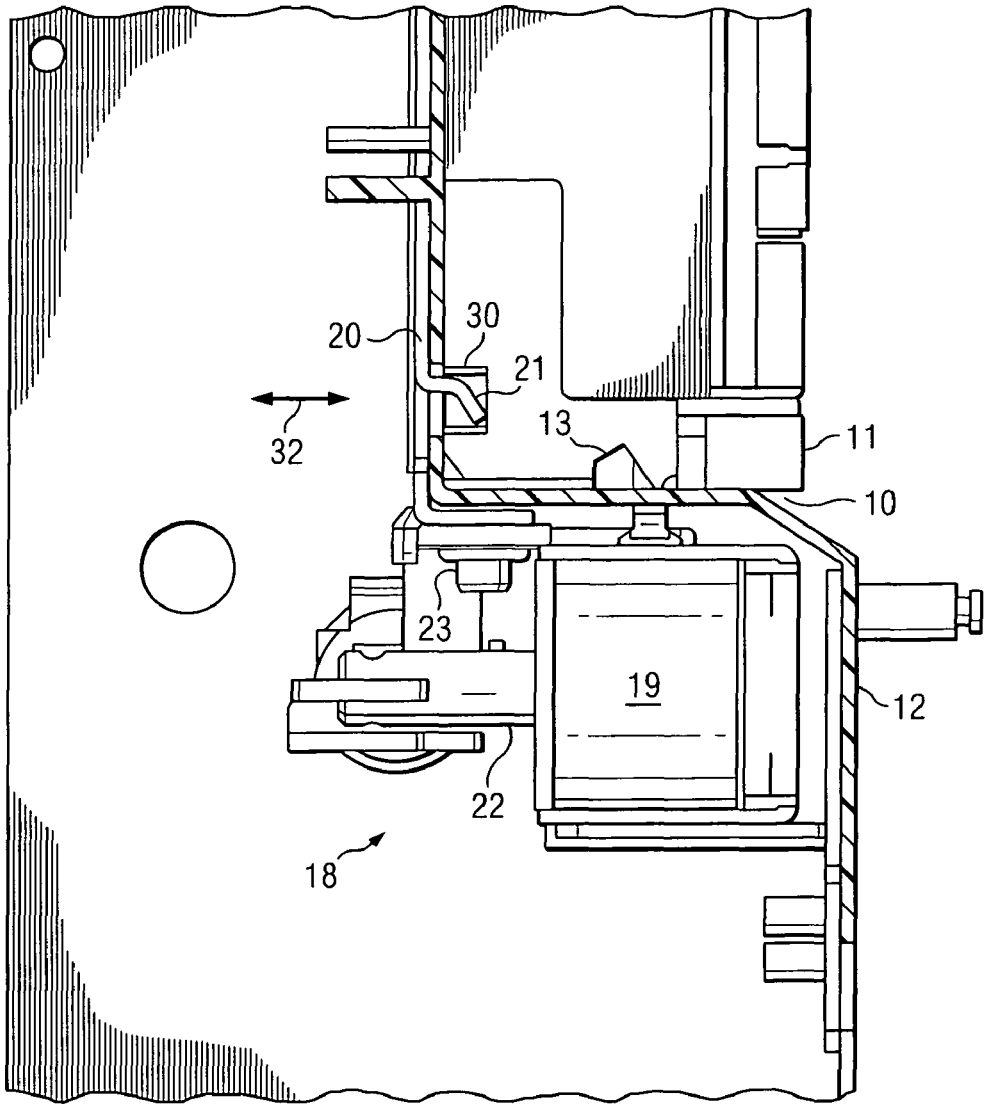
FIG. 6 is a side view of the canister/chassis interface of the embodiment of the invention shown in FIG. 1.

When the coin canister 2 is inserted into the opening 5 of the coin dispenser 1, the foot 11 may rest on an internal chassis 12 at an interface 10, as shown in FIGS. 4 and 6. The coin canister 2 may be locked into the coin dispenser 1 according to the invention by a latch 20 extending through an opening in the internal chassis 12 to engage a feature of the coin canister 2 such as a slot 21. The latch 20 may be attached to a lever 24 that is mounted for rotation about a pivot point 23. A solenoid 19 may be coupled to the lever 24 by a solenoid plunger 22 so that activation of the solenoid 19 causes the latch 20 to move in the direction indicated by arrow 32, into and out of the slot 21, thereby respectively locking and unlocking the coin canister 2. A conventional key lock 28 may also be coupled to the lever 24 to enable manual operation of the locking mechanism 18.

The lever 24 may be biased by a spring 26 to hold the latch 20 in a position to engage the slot 21 in the coin canister 2. In this way, the coin canister 2 is preferably locked into the coin dispenser 1, absent actuation of the solenoid 19 or the key lock 28.

In another embodiment of the present invention, a coin canister may be provided with a feature such as a tab that slides into a slot of a coin dispenser. While the coin canister is being inserted into the coin dispenser, the tab may push aside a spring-loaded latch of the coin dispenser that springs back when the coin canister is in its dispensing position and locks the coin canister into the coin dispenser. In yet another embodiment of the invention, a spring-loaded tab may protrude from or be enclosed in a notch or slot of a coin canister. Such a feature may interact with a retractable latch of a coin dispenser that is firmly held in one of two positions to lock the coin canister into place or allow its removal, respectively.

As may be seen in FIG. 6, the latch 20 may be provided with an angled upper surface 30. As the coin canister 2 is inserted into the opening 5 of the coin dispenser 1, the foot 11 of the coin canister 2 may act on the surface 30 to push the latch 20 back through the opening in the internal chassis 12. Once the coin canister is fully seated on the interface 10, the spring 26 may act to cause the latch 20 to engage the slot 21 and lock the coin canister 2 into the coin dispenser 1. In this way, the coin canister 2 may be reinserted into the coin dispenser and locked into place without requiring activation of either the solenoid 19 or the key lock 28.

Figure 7:
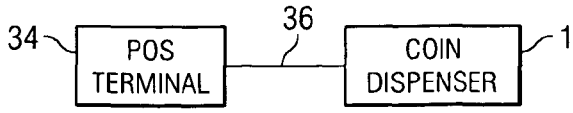
FIG. 7 depicts a block diagram of a system for dispensing coins according to the invention.

The solenoid 19 may be electrically connected for actuation by a signal generated from a remote source. As shown in FIG. 7, a point of sale (POS) terminal 34 may be associated with the coin dispenser 1 according to the present invention. The POS terminal 34 may be electrically connected to the coin dispenser 1 by a link 36. A cashier or manager may enter a command or combination of key strikes at the POS terminal 34 may cause an electrical signal to be sent over the link 36 to actuate the solenoid 19 in the coin dispenser 1 and unlock the coin canister 2.

Figure 8:
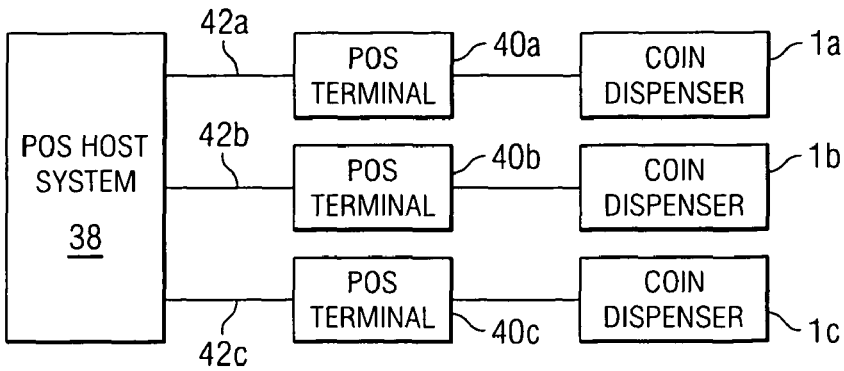
FIG. 8 presents a block diagram of another system for dispensing coins according to the invention.

In another embodiment of the invention, shown in FIG. 8, a central POS host system 38 may be electrically connected to POS terminals 40*a*, 40*b* and 40*c* by links 42*a*, 42*b* and 42*c*, respectively, to allow coin canisters to be unlocked from a central location. A command issued by the POS host system 38 to the POS terminal 40*a*, for example, may cause the POS terminal 40*a* to send an electrical signal to the coin dispenser 1*a* to unlock its associated coin canister. In another embodiment of the invention, a POS host system may be individually connected to one or more POS terminals and associated coin dispensers. In such an embodiment, the POS host system may send an electrical signal directly to one of the coin dispensers to unlock its coin canister.

In either of the embodiments shown in FIGS. 7 and 8, identity and date-stamp information may be collected when a coin canister is unlocked, for record-keeping purposes and to provide administrative flexibility.

It should be understood that the above description is only illustrative of the invention. Various alternatives and modifications may be devised by those skilled in the art without departing from the invention. Accordingly, the present invention is intended to embrace all such alternatives, modifications and variances that fall with the scope of the appended claims.

What is claimed is:

1. A coin dispenser, comprising:

a coin canister comprising a removable cover that secures coins in the coin canister from unauthorized removal from the coin canister, the coin canister comprising a series of tubular receptacles; and a latch, wherein the latch is operable to automatically lock the coin canister against unauthorized removal from the coin dispenser when the coin canister is placed into a first position for dispensing a coin from the coin dispenser, wherein the cover includes a plurality of circular openings for manually loading a plurality of coins into the coin canister in a single action without removing the coin canister from the first position, wherein each of the plurality of circular openings is aligned with one of the series of tubular receptacles.

2. The coin dispenser of claim 1, further comprising a remotely operable mechanism operable to unlock the coin canister from the coin dispenser.

3. The coin dispenser of claim 1, wherein the coin canister is operable to couple with the coin dispenser in a second position for loading coins into the coin canister.

4. The coin dispenser of claim 3, wherein the coin canister comprises a feature operable while the coin canister is in the second position to couple with the coin dispenser to retain the coin canister in the second position.

5. The coin dispenser of claim 3, wherein the coin dispenser comprises a feature operable while the coin canister is in the second position to couple with an edge of the coin canister to retain the coin canister in the second position.

6. The coin dispenser of claim 1, wherein each receptacle in the series of tubular receptacles comprises:

an aperture for manually loading a plurality of coins into the receptacle and retaining coins in the receptacle.

7. The coin dispenser of claim 1, wherein the coin canister comprises a repositionable handle, the repositionable handle operable in a first position to cover an aperture of each receptacle in the series of tubular receptacles and operable in a second position to facilitate transporting the coin canister.

8. A coin canister for use in a coin dispenser, the coin canister comprising:

a series of tubular receptacles;

a first feature operable to couple with a latch of the coin dispenser to automatically lock the coin canister against unauthorized removal from the coin dispenser when the coin canister is placed into a first position for dispensing a coin from the coin dispenser; and a removable cover that secures coins in the coin canister from unauthorized removal from the coin canister, wherein the cover includes a plurality of circular openings for manually loading a plurality of coins into the coin canister in a single action without removing the coin canister from the first position, wherein each of the plurality of circular openings is aligned with one of the series of tubular receptacles.

9. The coin canister of claim 8, further comprising a second feature operable to couple the coin canister with a coin dispenser in a second position for inserting coins into the coin canister.

10. The coin canister of claim 8, wherein each receptacle in the series of tubular receptacles comprises:

an aperture for manually loading a plurality of coins into the receptacle and retaining coins in the receptacle.

11. The coin canister of claim 8, further comprising:

a repositionable handle, wherein the repositionable handle is operable in a first position to cover an aperture of each receptacle in the series of tubular receptacles and operable in a second position to facilitate transporting the coin canister.

12. A method for use with a coin dispenser comprising a coin canister, the coin canister comprising a series of tubular receptacles, the method comprising:

automatically locking the coin canister against unauthorized removal from the coin dispenser when the coin canister is placed in a first position for dispensing a coin from the coin dispenser; and securing coins in the coin canister with a removable cover that prevents unauthorized removal of the coins from the coin canister, wherein the cover includes a plurality of circular openings for manually loading a plurality of coins into the coin canister in a single action without removing the coin canister from the first position, wherein each of the plurality of circular openings is aligned with one of the series of tubular receptacles.

13. The method of claim 12, further comprising remotely operating a mechanism to unlock the coin canister from the coin dispenser.

14. The method of claim 12, further comprising coupling the coin canister with the coin dispenser in a second position for loading coins into the coin canister.

15. The method of claim 14, wherein coupling the coin canister with the coin dispenser in the second position further comprises coupling a feature of the coin canister with the coin dispenser to retain the coin canister in the second position.

16. The method of claim 14, wherein coupling the coin canister with the coin dispenser in the second position further comprises coupling a feature of the coin dispenser with the coin canister to retain the coin canister in the second position.

17. The method of claim 12, further comprising providing an aperture for each receptacle in the series of tubular receptacles, the aperture configured for manually loading a plurality of coins into the receptacle and retaining coins in the receptacle.

18. The method of claim 12, further comprising providing a repositionable handle, wherein the repositionable handle is operable in a first position to cover an aperture of each receptacle in the series of tubular receptacles and operable in a second position to facilitate transporting the coin canister.

19. A coin dispenser, comprising:

a coin canister, operable to couple with the coin dispenser in a first position for loading coins into the coin canister and in a second position for dispensing a coin from the coin dispenser;

a latch operable to automatically lock the coin canister against unauthorized removal from the coin dispenser when the coin canister is placed into the second position; and a remotely operable mechanism operable to unlock the coin canister from the coin dispenser, wherein the coin canister comprises:

a series of tubular receptacles; and a removable cover that secures coins in the coin canister from unauthorized removal from the coin canister and the cover includes a plurality of circular openings for manually loading a plurality of coins into the coin canister in a single action without removing the coin canister from the second position, wherein each of the plurality of circular openings is aligned with one of the series of tubular receptacles.

20. The coin dispenser of claim 19, wherein the coin canister comprises a feature operable while the coin canister is in the first position to couple with the coin dispenser to retain the coin canister in the first position.

21. The coin dispenser of claim 19, wherein the coin dispenser comprises a feature operable while the coin canister is in the first position to couple with an edge of the coin canister to retain the coin canister in the first position.

22. The coin dispenser of claim 19, wherein each receptacle in the series of tubular receptacles comprises an aperture for manually loading a plurality of coins into the receptacle and retaining coins in the receptacle.

23. The coin dispenser of claim 19, wherein the coin canister comprises a repositionable handle, the repositionable handle operable in a first position to cover an aperture of each receptacle in the series of tubular receptacles and operable in a second position to facilitate transporting the coin canister.

24. A system for dispensing coins, comprising:

a controller; and a coin dispenser electrically connected to the controller, the coin dispenser comprising a coin canister and a latch operable to automatically lock the coin canister against unauthorized removal from the coin dispenser when the coin canister is placed in a dispensing position, wherein the coin canister comprises:

a series of tubular receptacles; and a removable cover that secures coins in the coin canister from unauthorized removal from the coin canister, wherein the cover includes a plurality of circular openings for manually loading a plurality of coins into the coin canister in a single action without removing the coin canister from the dispensing position, wherein each of the plurality of circular openings is aligned with one of the series of tubular receptacles;

wherein the controller is operable to send an electrical signal to the coin dispenser that causes the latch to unlock the coin canister from the coin dispenser.

25. The system of claim 24, wherein the controller is one of a point-of-sale (POS) terminal and a POS host system.

26. The system of claim 24, wherein the controller is a POS host system and the coin dispenser is a first coin dispenser of a plurality of coin dispensers.

* * * * *

UNITED STATES PATENT AND TRADEMARK OFFICE

CERTIFICATE OF CORRECTION

PATENT NO. : 7,740,529 B2
APPLICATION NO. : 11/525206
DATED : June 22, 2010
INVENTOR(S) : Quattrini et al.

It is certified that error appears in the above-identified patent and that said Letters Patent is hereby corrected as shown below:

Column 1, line 29, delete “ill” and replace with --in--.

Signed and Sealed this
Thirty-first Day of May, 2011

David J. Kappos

David J. Kappos
*Director of the United States Patent and Trademark Office*